United States Patent [19]

Barton

[11] 4,296,787

[45] Oct. 27, 1981

[54] CONNECTION DEVICE FOR GOLF CLUB HEAD COVERS

[76] Inventor: C. D. Barton, 815 W. 53rd Ter., Kansas City, Mo. 64112

[21] Appl. No.: 140,439

[22] Filed: Apr. 15, 1980

[51] Int. Cl.[3] ..... B65B 11/00; B65D 65/02; B65N 81/00

[52] U.S. Cl. ..... 150/52 G; 150/1.5 R

[58] Field of Search ..... 150/1.5 R, 1.5 B, 52 G, 150/1.5 C; 220/375

[56] References Cited

U.S. PATENT DOCUMENTS 1,957,577 5/1934 Chapman ..... 150/52 G 2,532,195 11/1950 Rosenow et al. ..... 150/52 G 4,126,166 11/1978 Hohenstein ..... 150/52 G X

*Primary Examiner*—George T. Hall

*Attorney, Agent, or Firm*—Lowe, Kokjer, Kircher, Wharton & Bowman

[57] ABSTRACT

An elongate flexible cord cooperates with a plurality of coil springs to interconnect golf club head covers. The cord is passed through eyelets attached to the head covers. The coil springs are sleeved over the cord and extend between adjacent eyelets to resist tangling of the cord while permitting it to bend as the head covers are removed and replaced on the club heads.

10 Claims, 2 Drawing Figures

CONNECTION DEVICE FOR GOLF CLUB HEAD COVERS

BACKGROUND AND SUMMARY OF THE INVENTION

This invention relates generally to the connection of golf club head covers to one another and more particularly to an improved arrangement for accomplishing such connection.

The head covers for "wood" golf clubs are typically connected to one another by a simple cord or strap which is passed through the eyelets of the head covers. Although this type of connection keeps the head covers together and prevents them from being separated or lost, it is less than satisfactory in a number of respects. Most significantly, the cord often becomes tangled in itself and with the head covers and other things. Also, the head covers are free to slide along the cord and tend to bunch together, making them difficult to apply to and remove from the golf clubs. Bunching of the covers also exposes one or more long sections of the cord and thereby increases the tendency for the cord to become tangled. Knitted head covers are usually not connected with one another at all and are thus easily lost.

The present invention is aimed primarily at eliminating these problems and has, as its principal object, the provision of an improved device for connecting golf club head covers in a tangle free yet unencumbered fashion. This is achieved by employing a cord which receives a plurality of coil springs serving as separators extending between the eyelets of the head covers. The springs are stiff enough to resist tangling and yet are flexible enough to permit the covers to be easily removed and replaced on the golf clubs.

Another object of the invention is to provide a device of the character described which prevents the head covers from bunching together. Again, the springs are important in that they maintain the head covers at the desired locations spaced properly apart from one another.

Still another object of the invention is to provide a device of the character described which is well adapted for use with various types of head covers, including knitted covers as well as plastic covers equipped with eyelets.

A further object of the invention is to provide a device of the character described which effectively utilizes the eyelets of the head covers without the need to knot the cord to them.

An additional object of the invention is to provide a device of the character described which includes a simple but effective arrangement for preventing the ends of the cord from passing through the adjacent eyelets.

Yet another object of the invention is to provide a device of the character described which facilitates handling of the head covers and which provides a clear visual indication in the event there is a tangling problem or other awkward positioning of the cord or head covers.

A still further object of the invention is to provide a device of the character described which is simple and economical and which is unaffected by weather conditions such as temperature or moisture.

Another object of the invention is to provide a device of the character described which includes a simple yet effective fastening arrangement for attaching the cord to knitted head covers without the possibility of tangling in the tassels or other parts of the covers.

Other and further objects of the invention, together with the features of novelty appurtenant thereto, will appear in the course of the following description.

DETAILED DESCRIPTION OF THE INVENTION

Figure 1:
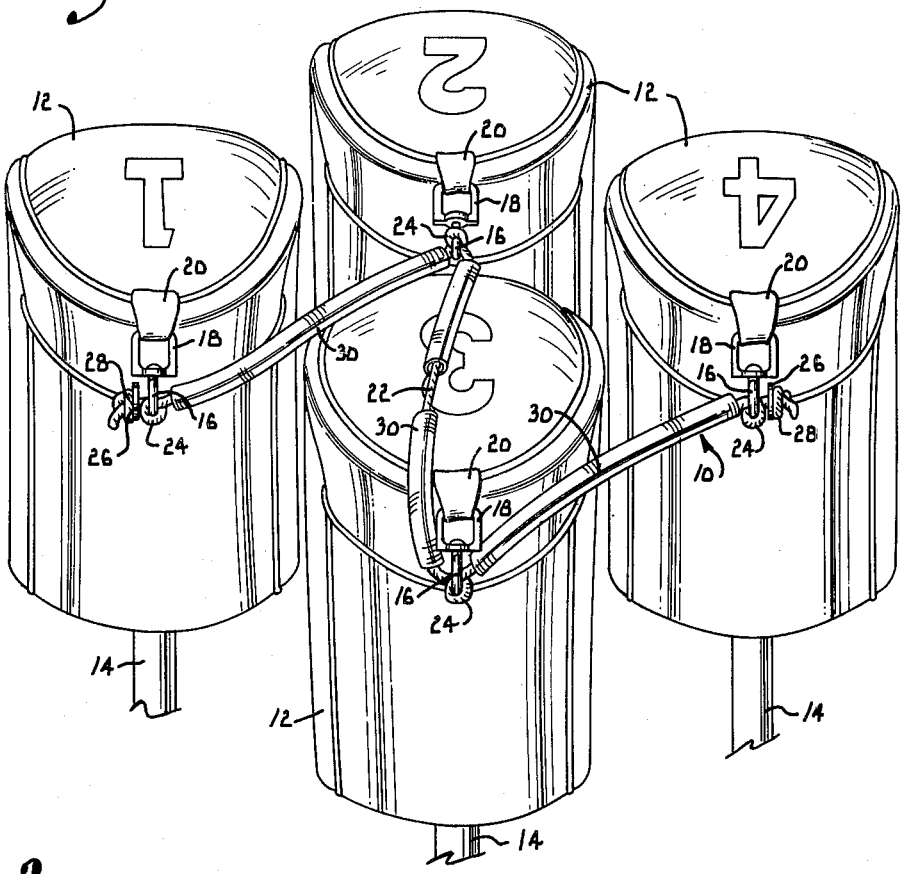
Figure 2:
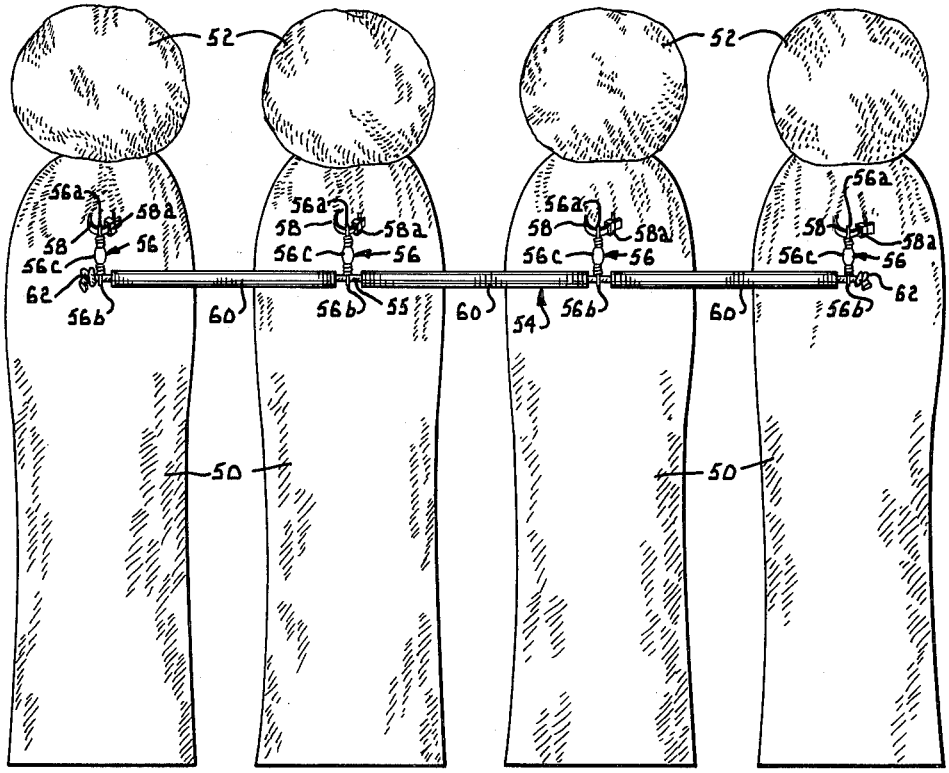

In the accompanying drawing which forms a part of the specification and is to be read in conjunction therewith and in which like reference numerals are used to indicate like parts in the various views:

FIG. 1 is a perspective view illustrating a plurality of plastic vinyl golf club covers connected with one another by a head cover connection device constructed according to a preferred embodiment of the present invention, with a central portion of one of the coil springs broken away for purposes of illustration; and FIG. 2 is an elevational view illustrating a plurality of knitted club head covers connected with one another by a second embodiment of the connection device.

In accordance with the present invention, a head cover connection device generally indicated at 10 in FIG. 1 interconnects a plurality of vinyl golf club head covers 12 which are used to cover the club heads (not shown) of "wood" golf clubs each having a shaft 14. Each head cover 12 has the usual eyelet 16 which is mounted to pivot on a swivel 18 in a conventional manner. Each swivel 18 is attached to a fabric loop 20 extending from the associated head cover 12.

The connection device 10 of the present invention includes an elongate flexible cord 22 which may be formed of a braided plastic substance of any suitable type, such as coated nylon for example. It is to be understood that cord 22 may be replaced by a leather strap, a chain, or any other suitable member having the required strength and flexibility. Cord 22 is passed through each eyelet 16 and is looped once around each eyelet as indicated at 24. The loops 24 prevent the eyelets from sliding freely along the cord and springs so as to bunch the head covers together, and they also provide "hinge joints" in cord 22 at the eyelets.

The opposite ends of cord 22 are knotted, and the knots are prevented from passing back through the adjacent eyelets 16 by a pair of metal washers 26. Each washer 26 is held on cord 22 by a knot 28 formed in the cord near each end thereof. Each washer 26 is located between knot 28 and the adjacent eyelet 16 and is larger than the eyelet such that it is unable to pass back through the eyelet. This manner of securing the ends of the cord is preferred because it is simple enough to be carried out by the public and avoids the need to tie the cord to the eyelets, which can only be done by a bow line knot or other complicated knot the public cannot be expected to tie.

Head covers 12 are maintained apart from one another by three coil springs 30 which are sleeved over cord 22 to extend substantially between each pair of adjacent eyelets 16. Each spring 30 is flexible enough to permit cord 22 to bend as required, while the resiliency of the springs causes them to tend to straighten, thereby preventing the cord from becoming tangled. In this manner, springs 30 serve as tubular shells which resist tangling of the cord. The loops 24 in cord 22 prevent springs 30 from passing through eyelets 16. In a preferred form of the invention, each spring 30 is approximately five inches long. It has been found that a spring of about five inches in length is ideal because it is not long enough to tangle or be awkward within the confines of the wood compartment of the bag and yet it is not so short that removal of one cover pulls off other covers.

Device 10 is attached to the head covers by forming knot 28 in one end and looping cord 22 around the adjacent eyelet 16 with washer 26 positioned between loop 24 and knot 28. One of the springs 30 is then slipped onto cord 22, and the cord is then looped around a second eyelet 16 prior to receiving another spring 30. When all of the springs 30 have been fitted on the cord in this fashion, the cord is looped around the last eyelet 16, washer 26 is fitted on the cord, and the second knot 28 is tied in the cord to complete attachment of the device to the head covers. It should be noted that any number of head covers can be connected by the device. It should also be noted that one of the knots 28 can be tied prior to shipping of the unit, leaving only one knot to be tied by the consumer.

In use, head covers 12 may be removed from the golf clubs and replaced thereon in the usual manner. The resiliency of springs 30 and their tendency to straighten resists tangling of cord 22, and the springs also act as separators to prevent the covers from bunching together. The springs maintain the covers at the proper positions and prevent them from moving too close together (which could hamper their handling) or too far apart (which is undesirable due to the confined space of the bag.) During removal of each cover 12 from its club head, the cover barely clears the club head as the cord tension begins to pull on adjacent head covers.

The springs 30 are flexible enough to bend in the manner required during handling of the head covers. At the same time, the springs are resilient enough to resist tangling of the cord. If tangling or other awkward positioning of the connector device begins to occur, it is immediately highly visible and the proper preventive action can be taken. Each spring 30 is in a single segment and thus acts in the manner of a handle to facilitate handling and control of the head covers. Cord 22 and springs 30 are not susceptible to damage due to moisture or thermal changes, and the device does not become brittle in cold weather as can occur with some materials. The device is tough enough to withstand the rough handling to which it is often subjected, and yet it provides the necessary control and flexing action required for easy handling of the head covers. It is again pointed out that there is no need to knot cord 24 to eyelets 16 since a simple loop around each eyelet is all that is required. In addition, springs 30 are not physically attached to the head covers but are instead simply sleeved onto cord 22.

It is thus apparent that the device of the present invention effectively connects the head covers while resisting tangling and bunching of the covers. The covers may be easily applied to and removed from the golf clubs without resistance from the connection device, and the removal of one club cover does not pull other covers off of their club heads.

FIG. 2 illustrates a second embodiment of the invention which serves to interconnect a plurality of knitted golf club head covers 50 and each having a large tassel 52 at its top end. The head covers 50 are used to cover the club heads of "wood" golf clubs (not shown). Head covers 50 differ from the vinyl head covers 12 in that they are knitted from yarn or the like. Covers 50 are provided with a number on the side opposite that visible in FIG. 2.

In accordance with the second form of the invention, the knitted head covers 50 are interconnected by a connection device which is generally designated by reference numeral 54. Connection device 54 is generally similar to the connection device 10 described in connection with the first embodiment of the invention, but is modified somewhat in order to accomodate the knitted covers 50. Connection device 54 includes an elongate flexible cord 55 which may be constructed of a braided plastic substance such as coated nylon. Cord 55 is attached to the head covers 50 by swivel elements 56 which are secured to the respective head covers by small tie belts 58. Each swivel element 56 is constructed conventionally and has a pair of eyelets **56*a* and 56*b* at opposite ends and a body portion 56*c* located between the eyelets. Each eyelet 56*a* and 56*b* is rotatable relative to the body portion 56*c***.

To attach swivel elements 56 to head covers 50, tie belts 58 are threaded through the body of the respective head covers at locations spaced approximately one and one half inches below the base of the tassels 52. This maintains the connection device far enough away from the tassels to avoid becoming entangled therein. Tie belts 58 are preferably threaded through approximately $\frac{3}{8}$ inch of material on a line extending perpendicular to the length of the cover. Each belt 58 is then threaded through eyelet **56*a* of the swivel element and is secured by passing the free end of the belt through block 58*a*** which serves as a buckle to hold the free end of the belt in place in a conventional manner.

Cord 55 is threaded through eyelet **56*b* of each swivel element 56. Three coil springs 60 are sleeved onto cord 55 and extend substantially between adjacent pairs of swivel elements 56. Springs 60 are flexible enough to permit cord 55 to bend as required, while the resiliency of the springs tends to straighten them out, thus preventing the cord from becoming tangled. The springs serve as tubular shells which resist tangling of the cord. The free portions of cord 55 located between springs 60 provide "hinge" joints about which the cord may flex. Like the springs of the first embodiment of the invention, springs 60** are preferably about five inches long.

Knots 62 are formed in the opposite ends of cord 55 and are larger than eyelets **56*b*** so that the knots cannot pass back through the eyelets of the adjacent swivel elements. The cord, springs and swivel elements may be assembled prior to shipping.

Connection device 54 functions in substantially the same manner as the connection device 10 described previously. Springs 60 are much larger in diameter than eyelets **56*b*, and the springs thus serve as separators which prevent the covers from bunching together, as well as resisting any tendency for the cord to tangle. The tie belts 58 provide a simple and convenient means for attaching swivel elements 56 to the knitted head covers 50, and such attachment can be easily carried out by the general public. Since the swivel elements are attached opposite the numbers (not shown) on the head covers, the numbers are visible at all times and are not obstructed by the connection device. The swivel connections provided by elements 56 permit head covers 50** to turn relative to the connection device without the possibility of tangling or snarling.

From the foregoing it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention I claim:

1. A device for interconnecting a plurality of golf club head covers each having an eyelet, said device comprising:

an elongate flexible member extending between the eyelets of the head covers, said flexible member passing through the eyelet of each head cover to connect the head covers to one another;

means associated with opposite end portions of said flexible member for preventing the opposite end portions from passing through the eyelets located nearest the end portions; and a plurality of tubular elements sleeved on said flexible member and extending substantially between the eyelets of the respective head covers in a manner to maintain the head covers spaced apart from one another, said tubular elements being resilient to permit flexing thereof.

2. The invention of claim 1, wherein said flexible member is looped around each eyelet.

3. The invention set forth in claim 1, wherein each tubular element is in the form of an elongate coil spring resiliently biased toward a substantially straight condition.

4. The invention set forth in claim 3, wherein said flexible member comprises a cord which is looped around each eyelet at locations between the springs.

5. The invention set forth in claim 1, wherein said preventing means includes a retainer element mounted on said flexible member between each end thereof and the adjacent eyelet, each retainer element being secured on the flexible member and being sufficiently large to prevent its passage through the eyelets.

6. The invention set forth in claim 5, wherein each retainer member is secured on said flexible member by a knot in the flexible member.

7. A device for interconnecting a plurality of golf club head covers, said device comprising:

a swivel element for each head cover, each swivel element having an eyelet;

means for attaching said swivel elements to the respective head covers with said eyelets exposed;

an elongate flexible member passing through each eyelet to connect the head covers to one another;

means for preventing opposite end portions of said flexible member from passing through the eyelets located nearest the end portions; and a plurality of tubular elements sleeved on said flexible member and extending substantially between adjacent pairs of eyelets in a manner to maintain the head covers spaced apart from one another, said tubular elements being resilient to permit flexing thereof.

8. A device as set forth in claim 7, wherein each tubular elememnt comprises an elongate coil spring resiliently biased toward a substantially straight condition.

9. A device as set forth in claim 7, wherein said preventing means includes a knot in each end portion of said flexible member, said knots being larger than the eyelets.

10. A device as set forth in claim 7, wherein:

each swivel element presents a second eyelet spaced from the first mentioned eyelet and a body portion located between the eyelets and rotatable relative thereto; and said attaching means includes a tie member for each swivel element, said tie members being threaded through the bodies of the respective head covers and through the second eyelets of the respective swivel elements to attach the swivel elements to the head covers.

* * * * *